United States Patent [19]

Layman et al.

[11] Patent Number: 4,489,115

[45] Date of Patent: Dec. 18, 1984

[54] SYNTHETIC TURF SEAM SYSTEM

[75] Inventors: Bruce W. Layman, Dallas; Billy G. Privett, Fort Worth, both of Tex.

[73] Assignee: SuperTurf, Inc., Garland, Tex.

[21] Appl. No.: 467,356

[22] Filed: Feb. 16, 1983

[51] Int. Cl.[3] ..... B32B 3/06

[52] U.S. Cl. ..... 428/62; 24/306; 156/61; 156/66; 156/93; 156/258; 156/304.4; 156/304.5; 156/574; 428/17; 428/100; 428/104

[58] Field of Search ..... 156/61, 66, 91–93, 156/198, 258, 304.1, 304.3, 304.4, 304.5, 304.7, 574; 404/122, 131; 24/306, 204, 265 EE, DIG. 11, DIG. 18; 428/100, 95, 99, 101, 17, 60, 62, 102, 104

[56] References Cited

U.S. PATENT DOCUMENTS

| | | | |
|---|---|---|---|
| 1,894,548 | 1/1933 | Whitney | 404/131 |
| 3,242,509 | 3/1966 | Nissen | 428/100 X |
| 3,773,580 | 11/1973 | Provost | 156/66 |
| 3,849,840 | 11/1974 | Yamada et al. | 24/204 |
| 3,866,267 | 2/1975 | Poletti | 16/8 |
| 3,974,312 | 8/1976 | Stevens et al. | 428/91 |
| 4,012,544 | 3/1977 | Richards | 428/95 |
| 4,152,473 | 5/1979 | Layman | 428/17 |
| 4,208,151 | 6/1980 | Cross | 404/122 |

*Primary Examiner*—Robert Dawson

*Attorney, Agent, or Firm*—Hubbard, Thurman, Turner & Tucker

[57] ABSTRACT

A system and method for forming flat temporary seams between two sections of synthetic turf are disclosed. The synthetic turf includes a synthetic turf material having a polymeric backing thereon. A strip of the polymeric backing is removed along a first edge of a first section of synthetic turf and a first web of mated surface fastener material is fastened to the underside of the synthetic turf material along that edge. A strip of synthetic turf material is removed from the polymeric backing along a second edge of a second section of synthetic turf and a thickness of polymeric backing substantially equal to two mated webs of mated surface fastener material is removed from the exposed lip of polymeric backing. A second web of mated surface fastener material is then fastened to the exposed lip of polymeric backing along the second edge. A flat temporary seam may then be formed by overlapping and mating the first and second web of mated surface fastener material.

9 Claims, 3 Drawing Figures

SYNTHETIC TURF SEAM SYSTEM

BACKGROUND OF THE INVENTION

This invention relates to synthetic turf systems in general and in particular to systems and methods for producing flat temporary seams between two sections of synthetic turf. In another aspect, this invention relates to systems and methods for forming temporary seams in synthetic turf materials which provide greater lateral strength than previously known systems.

In recent years, synthetic turf materials have been widely used to cover athletic fields, parade grounds, playgrounds, highway medians, areas surrounding swimming pools, patios and the like. Such synthetic turf materials normally simulate a well manicured, natural grass surface in that the synthetic turf material is made up of a multitude of upstanding ribbon-like fibers that are secured to a base or a substrate. Such fibers as nylon, polypropylene, polyvinylchloride, foamed polyethylene and the like have been widely used as material for forming the upstanding grass leaf-like ribbons. Because of the durability of such materials of construction, it is possible to produce a simulated grass surface, or a synthetic turf material that stands up well under extremely harsh conditions. Such durable surfaces are now widely used for the surfaces of athletic playing fields and the like, wherein the synthetic turf is exposed to the grinding, abrasive, and twisting forces, caused by the shoes of athletes, animals and the like, as they walk or run across the surface of the synthetic turf.

Many techniques have been developed in recent years for the installation of synthetic turf materials, especially in outdoor installations. Thus, improved seam techniques for joining adjacent pieces of synthetic turf material together have reduced the number of failures experienced in large, synthetic turf installations. Improved techniques have also been developed for installing the synthetic turf materials over padding to produce a durable playing surface.

One very troublesome problem which continues to plague the synthetic turf industry is in the area of temporary synthetic turf installations. Certain synthetic turn installations are temporary in nature and require a system for securing and removing two adjacent sections of synthetic turn material. One example of this type of installation is the covering of the dirt or "skinned" portion of a synthetic turf baseball field to permit football or soccer to be played. In another example, large installations of synthetic turf have been utilized to provide a temporary turf-like condition within arenas, amphitheaters and the like for special athletic events or exhibitions. While the permanent mating or sealing of two adjacent sections of synthetic turf material is a problem for which many satisfactory solutions exist, in the aforementioned temporary installations there exists no suitable method of forming a flat temporary seam between two adjacent sections of synthetic turf material. Some attempts have been made utilizing zippers or tape; however, these attempts have generally failed due to the inability of such methods to produce a flat seam, in the case of the former, or the lack of lateral strength in the resultant seam, in the case of the latter.

It is, therefore, apparent that there exists a need for an improved temporary seam and method for forming the seam between two adjacent sections of synthetic turf material. It is also apparent that there is a need for a seam which is flat and provides good lateral strength, yet may be quickly and easily parted and reinstalled over long periods of use and exposure to the elements.

SUMMARY OF THE INVENTION

Accordingly, it is one object of the present invention to provide an improved temporary seam and method for forming the seam between two sections of synthetic turf material.

It is another object of the present invention to provide an improved temporary seam and method for forming the seam which will provide a flat surface and exhibit good lateral strength.

It is yet another object of the present invention to provide an improved temporary seam and method for forming the seam which may be quickly and easily parted and reinstalled over long periods of use.

The foregoing objects are achieved as is now described. In the instant invention, a synthetic turf is provided which includes a synthetic turf material having a polymeric backing thereon. A strip of the polymeric backing is removed along a first edge of a first section of synthetic turf and a first web of mated surface fastener material is fastened to the underside of the synthetic turf material along that edge. A strip of synthetic turf material is removed from the polymeric backing along a second edge of a second section of synthetic turf and a thickness of polymeric backing substantially equal to two mated webs of mated surface fastener material is removed from the exposed lip of polymeric backing. A second web of mated surface fastener material is then fastened to the exposed lip of polymeric backing along the second edge. A flat temporary seam may then be formed by overlapping and mating the first and second web of mated surface fastener material.

BRIEF DESCRIPTION OF THE DRAWINGS

The novel features believed characteristic of the invention are set forth in the appended claims. The invention itself; however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
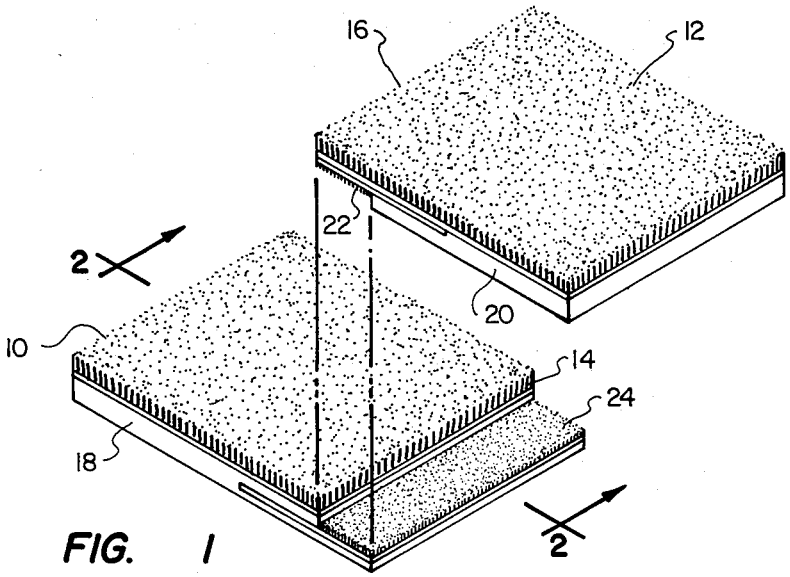
FIG. 1 is an exploded perspective view of the novel synthetic turf seam of the present invention.

With reference now to the figures, and in particular with reference to FIG. 1, there is depicted an exploded perspective view of the novel synthetic turf seam of the present invention. In FIG. 1, turf section 10 and turf section 12 are positioned such that edge 14 and edge 16 will abut against each other when the seam is formed. Normally in the installation of a large area of synthetic turf, edge 14 and edge 16 will be straight edges and turf section 10 and turf section 12 will be large adjoining rolls of synthetic turf material; however, in certain applications edge 14 and edge 16 may be curved or cornered to practically any shape.

Turf sections 10 and 12 each have a multitude of filaments or fibers extending upwardly from the surface thereof. This multitude of upstanding filaments is constructed of foamed polyethylene in the present embodiment and can be cut or formed to any desired length to give the top surface of each turf section a grass-like appearance. As is well known in the art, the filaments may be colored to any desired color to further enhance the appearance of natural grass.

Disposed along the underside of turf sections 10 and 12 are polymeric backing materials 18 and 20. Polymeric backing materials 18 and 20 may be provided utilizing any known polymer normally utilized in the construction of synthetic turf material, and in the preferred embodiment of the present invention are provided utilizing polyurethane foam which is glued to the foamed polyethylene turf material. Most synthetic turf materials utilize type of polymer backing or coating that forms an integral part of the synthetic turf material to lend dimensional stability to the turf material and to provide a shock absorbing underlay for the synthetic turf. Usually the polymer backing is a foamed polymer material that is made up of a multitude of closed cells that are filled with a compressible gas to produce the desired padded base of the synthetic turf material. Such foamed polymer materials include foamed polyethylene, foamed butadiene-styrene rubber, foamed polyurethane, foamed polyvinylchloride, foamed rubber and the like.

In the instant invention, a strip of polymeric backing material 20 has been removed from along edge 16 of turf section 12 and a web of mated surface fastener material 22 has been fastened to the underside of turf section 12 along edge 16. A similarly sized strip of turf section 10 has been removed to form edge 14 and an additional thickness of polymeric backing material 18 has been removed for reasons which will be explained in detail herein. A second web of mated surface fastener material 24 has been fastened to the upper surface of this exposed lip of polymeric backing material 18 and a lap joint of edges 14 and 16 may be formed by overlapping and mating the two webs of mated surface fastener material.

In the preferred embodiment of the present invention, webs 22 and 24 are comprised of a mated surface interlocking fastener material marketed under the registered trademark Scotchmate by the 3M Company, St. Paul, Minn. However, those ordinarily skilled in the art will appreciate that other types of mated surface fastener materials will find similar application in the novel synthetic turf seam of the present invention. Such mated surface interlocking fasteners are well known in the art and function by interlocking vertical upstanding members that are oppositely disposed on the mating strips. It will be appreciated that materials such as Velcro fasteners fall within the broad description of such fasteners.

Figure 2:
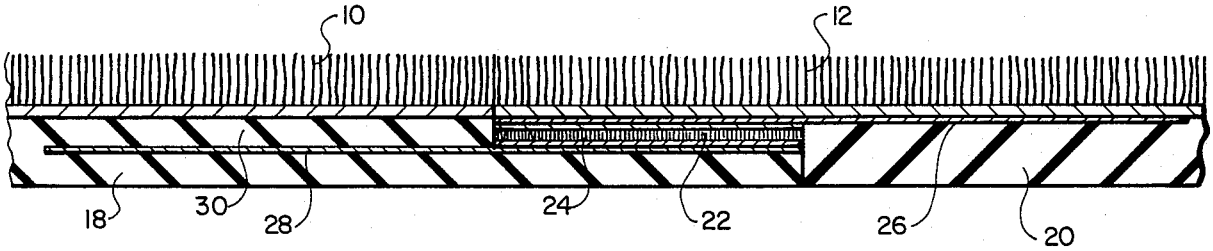
FIG. 2 is a sectional view of the novel synthetic turf seam of FIG. 1.

The preferred method of fastening webs 22 and 24 to turf sections 10 and 12, as well as the construction which provides the great lateral strength demonstrated by the novel seam of the present invention, can be better understood by reference to FIG. 2, which depicts a sectional view of the novel synthetic turf seam of the present invention.

A difficulty in providing the great lateral strength required in certain temporary installations of synthetic turf involves the fact that the mated surface fastener material utilized in the present invention includes a polymer backing material which is often difficult to bond to the foamed polymer which provides the underlying pad of turf sections in the depicted embodiment, or to the backing of the overlying turf section to produce strong seams. To overcome this problem and to give each seam a broad base for its lateral strength, each web of mated surface fastener material utilized in the present invention is first mechanically fastened to a substantially wider web of strong fabric. Then the web can be affixed to the pieces of turf material as hereinafter described to produce extremely strong seams, especially in the lateral direction.

In the preferred embodiment of the present invention, web 22 is approximately two inches in width and is mechanically fastened, by sewing, to fabric web 26 which is approximately four and one half inches in width. Similarly, web 24 is mechanically fastened, by sewing, to fabric web 28. Those skilled in the art will appreciate that mated surface fastener webs 22 and 24 may, in the alternative, be sewn and glued to fabric webs 26 and 28 or simply glued to fabric webs 26 and 28 or to polymeric backing material 18 and turf section 12, with an attendant decrease in lateral strength. Further, the dimensions and ratios of dimensions of the mated surface fastener webs and fabric webs may be altered to fit specific applications and situations.

Fabric webs 26 and 28, in the depicted embodiment of the present invention, are provided by utilizing a strong nylon material with a water repellent finish. One such material is marketed by the E. I. DuPont De Nemours Company under the trademark Cordura. As can be seen in FIG. 2, fabric web 26 is fastened to the underside of turf section 12, along edge 16. Polymeric backing material 20 has been cut back from edge 16 to the width of mated surface fastener web 22 and peeled back an additional distance to permit fabric web 26 to be laminated between turf section 12 and polymeric backing material 20. Preferably, fabric web 26 has been glued to the underside of turf section 12 and polymeric backing material 20 has been glued to the underside of fabric web 26 utilizing any well known glue such as a moisture activated polyurethane glue.

An important aspect of the present invention may be seen with respect to the mounting of mated surface fastener web 24 to turf section 10. As can be seen, a strip of turf section 10 has been removed from one side to form edge 14, and an underlying lip of polymeric backing material 18 is exposed. Turf section 10 is then peeled up exposing a portion of polymeric backing section 18 equal in width to fabric web 28. A thickness of polymeric backing material 18 has been removed in an amount substantially equal to the thickness of mated surface fastener webs 22 and 24 when they are mated, and fabric web 28 is then glued to the top of the remaining exposed lip of polymeric backing material 18. A web of polymeric backing material 30 is then glued to the top of fabric web 28 which is not covered by mated surface fastener web 24, and turf section 10 is then glued to web 30 to form a flat surface. Those skilled in the art will appreciate that the removal of the aformentioned thickness of polymeric backing material 18 will permit the seam formed by the mating of mated surface fastener webs 22 and 24 to be flat and unobtrusive when complete.

Figure 3:
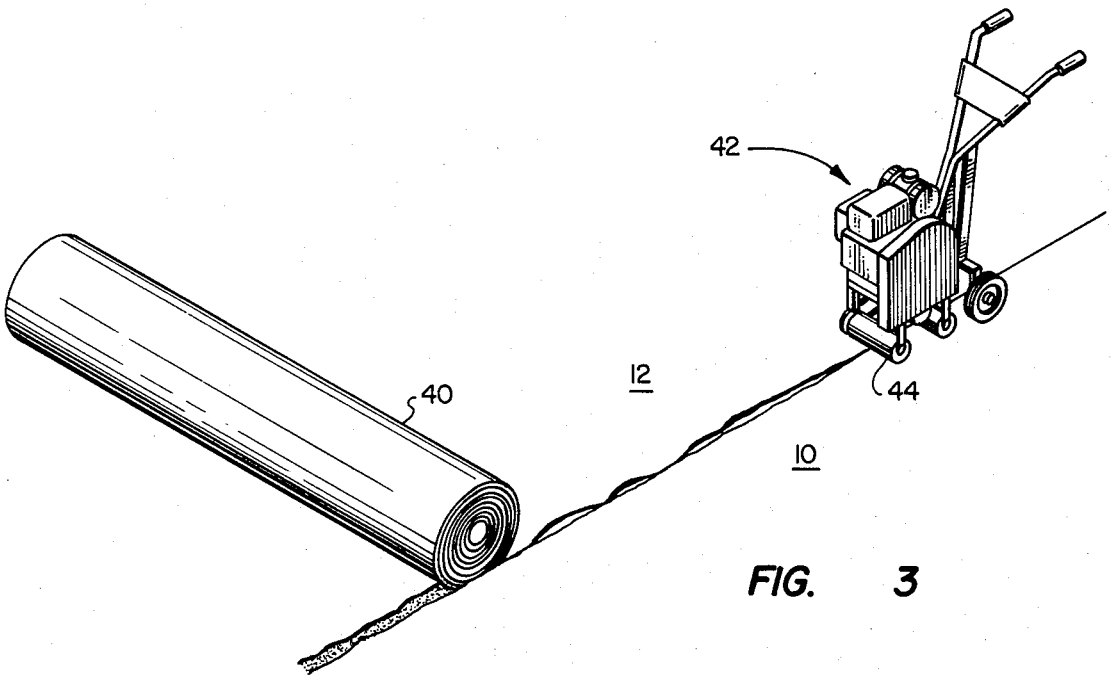
FIG. 3 is a perspective view of the seam mating apparatus utilized in conjunction with the novel synthetic turf material seam of the present invention.

Finally, with reference to FIG. 3, there is depicted a perspective view of a device which may be utilized to close the seam provided by the method of the present invention. As can be seen, turf sections 10 and 12 are abutted in the manner well known in the art, with turf section 12 comprising a section of an entire roll 40 of synthetic turf material. A seam sealing device 42 is then provided which includes a powered roller 44 which can be utilized to roll mated surface fastener webs 22 and 24 (see FIG. 2) into the fully mated position. Sealing device 42 may be provided utilizing any well known portable device capable of powering a roller such as roller 44 and may be powered utilizing electrical motors or internal combustion engines. When the need to remove this installation arises the seams provided by this method may be simply and easily peeled apart and repetitively installed as may be necessary.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

What is claimed is:

1. A system for forming a flat temporary seam between two sections of cushion backed synthetic turf material comprising:

a first section of synthetic turf material having a first edge;

a first fabric web fastened to the underside of said first section of synthetic turf material along said first edge;

a first web of mated surface fastener material fastened to a portion of the underside of said first fabric web along said first edge;

a first cushion backing fastened to the underside of said first section of synthetic turf material and the remainder of the underside of said first fabric web;

a second cushion backing having a second edge and a shoulder formed along said second edge;

a second fabric web fastened to the top of said shoulder of said second cushion backing along said second edge;

a second web of mated surface fastener material fastened to a portion of said second fabric web along said second edge;

a web of cushion backing material fastened to the top of the remainder of said second fabric web; and a second section of synthetic turf material fastened to the top of said second cushion backing and said web of cushion backing.

2. The system according to claim 1 wherein said synthetic turf material is provided utilizing a foamed polyethylene material.

3. The system according to claim 1 wherein said first and second cushion backing is provided utilizing a polyurethane foam.

4. The system according to claim 1 wherein said first fabric web is fastened to the underside of said first section of synthetic turf material by means of glue.

5. The system according to claim 4 wherein said first web of mated surface fastener material is fastened to a portion of the underside of said first fabric web by means of sewing.

6. The system according to claim 1 wherein said second fabric web is fastened to the top of said shoulder of said second cushion backing along said second edge by means of glue.

7. The system according to claim 6 wherein said second web of mated surface fastener material is fastened to a portion of said second fabric web along said second edge by means of sewing.

8. The system according to claim 1 further including means for mating said first and second webs of mated surface fastener material while said first edge and said second edge are abutting.

9. The system according to claim 8 wherein said mating means comprises a roller and means for driving said roller over the abutment of said first edge and said second edge.

* * * * *